US007666352B2

(12) United States Patent
Ishida et al.

(10) Patent No.: US 7,666,352 B2
(45) Date of Patent: Feb. 23, 2010

(54) IRIDIUM-BASED ALLOY WITH HIGH HEAT RESISTANCE AND HIGH STRENGTH AND PROCESS FOR PRODUCING THE SAME

(75) Inventors: Kiyohito Ishida, Sendai (JP); Ryosuke Kainuma, Natori (JP); Katsunari Oikawa, Sendai (JP); Ikuo Ohnuma, Shibata-gun (JP); Toshihiro Ohmori, Sendai (JP); Jun Sato, Sendai (JP)

(73) Assignee: Japan Science and Technology Agency, Saitama (JP)

( * ) Notice: Subject to any disclaimer, the term of this patent is extended or adjusted under 35 U.S.C. 154(b) by 0 days.

(21) Appl. No.: 12/112,306

(22) Filed: Apr. 30, 2008

(65) Prior Publication Data

US 2008/0206090 A1 Aug. 28, 2008

Related U.S. Application Data

(63) Continuation of application No. PCT/JP2007/052069, filed on Jan. 31, 2007.

(51) Int. Cl.
*C22C 5/04* (2006.01)
*C22F 1/14* (2006.01)

(52) U.S. Cl. ..... 420/461; 148/430

(58) Field of Classification Search ..... 148/430; 420/461

See application file for complete search history.

(56) References Cited

U.S. PATENT DOCUMENTS 4,705,610 A * 11/1987 Tenhover et al. ..... 205/474

(Continued)

FOREIGN PATENT DOCUMENTS

JP 8-311584 A 11/1996

(Continued)

OTHER PUBLICATIONS

J. Sato et al. Cobalt-Base High Temperature Alloys. Science 312, 90, (Apr. 7, 2006), p. 90-91.*

(Continued)

*Primary Examiner*—George Wyszomierski
*Assistant Examiner*—Mark L Shevin
(74) *Attorney, Agent, or Firm*—Westerman, Hattori, Daniels & Adrian, LLP

(57) ABSTRACT

An iridium-based alloy which has $L1_2$-type intermetallic compounds dispersedly precipitated therein and has a basic composition including, in terms of mass proportion, 0.1 to 9.0% Al, 1.0 to 45% W, and Ir as the remainder. The component system containing 0.1 to 1.5% Al has $L1_2$-type intermetallic compounds dispersedly precipitated therein. The component system containing 1.5 to 9.0%, excluding 1.5%, Al has $L1_2$-type and B2-type intermetallic compounds dispersedly precipitated therein. Part of the Ir may be replaced with an element (X) (Co, Ni, Fe, Cr, Rh, Re, Pd, Pt, or Ru) and part of the Al and W may be replaced with an element (Z) (Ni, Ti, Nb, Zr, V, Ta, Hf, or Mo). The iridium-based alloy, which contains $L1_2$-type intermetallic compounds [$1r_3$(Al,W) and [(Ir, X)$_3$ (Al, W, Z)] dispersedly precipitated therein, has a high melting point. The lattice constant mismatch between the $L1_2$-type intermetallic compounds, i.e., [$Ir_3$ (Al, W)] and [(Ir, X)$_3$(Al, W, Z)], and the matrix is small and, hence, the iridium-based alloy is excellent in high-temperature strength and structural stability.

7 Claims, 3 Drawing Sheets

U.S. PATENT DOCUMENTS

| | | | | |
|---|---|---|---|---|
| 6,071,470 | A * | 6/2000 | Koizumi et al. | 420/461 |
| 6,630,250 | B1 * | 10/2003 | Darolia | 428/632 |
| 2003/0136478 | A1 | 7/2003 | Mitarai et al. | |
| 2006/0165554 | A1 * | 7/2006 | Coupland et al. | 420/461 |

FOREIGN PATENT DOCUMENTS

| | | | |
|---|---|---|---|
| JP | 9-67632 | A | 3/1997 |
| JP | 10-259435 | A | 9/1998 |
| JP | 2000-290741 | A | 10/2000 |
| JP | 2001-303152 | A | 10/2001 |
| JP | 2002-285260 | A | 10/2002 |
| JP | 2004-197223 | * | 7/2004 |
| JP | 2005-267964 | A | 9/2005 |

OTHER PUBLICATIONS

Yamabe et al. Development of Ir-base Refractory Superalloys. Scripta Materialia, vol. 35, No. 2, (1996), p. 211-215.*

Yamabe et al. High-temperature mechanical properties of Ir-Al alloys. Scripta Materialia vol. 48, (2003), p. 565-570.*

Y. Yamabe-Mitarai et al; "Platinum-Group-Metal-Based Intermetallics as High-Temperature Structural Materials," JOM; Sep. 2004; pp. 34-39.

International Search Report of PCT/JP2007/052069, date of mailing Apr. 24, 2007.

* cited by examiner

Metallic structure of Ir-1.5Al-10.5W alloy

50nm

TEM image showing two-phase structure of Ir-1.5Al-10.5W alloy

B=[011]

Electronic diffraction image showing L12 structure of Ir-1.5Al-10.5W alloy

Temperature dependence of Vickers hardness

IRIDIUM-BASED ALLOY WITH HIGH HEAT RESISTANCE AND HIGH STRENGTH AND PROCESS FOR PRODUCING THE SAME

TECHNICAL FIELD

The present invention relates to an iridium-based alloy which is dramatically excellent in heat resistance and oxidation resistance compared to conventional nickel-based alloys, maintains the required strength even if it is exposed to a severe high-temperature atmosphere, and is suitable as members such as jet engines and gas turbines, and process for producing thereof.

BACKGROUND ART

With reference to gas turbine members, engine members for aircraft, chemical plant materials, engine members for automobile such as turbocharger rotors, and high temperature furnace members, the strength is needed under a high temperature environment and an excellent oxidation resistance is sometimes required. A nickel-based alloy and cobalt-based alloy have been used for such a high-temperature application.

Many of the nickel-based alloys are strengthened by the formation of γ'-phase [$Ni_3(Al,Ti)$] having an $L1_2$ structure. The γ'-phase gives excellent high temperature strength and high temperature creep characteristics because it has an inverse temperature dependence in which the strength becomes higher with rising temperature. The γ-phase becomes the nickel-based alloy suitable for heat-resistant applications such as rotor blades for gas turbine and turbine discs. On the other hand, the cobalt-based alloy is formed by using the solid solution strengthening and the precipitation strengthening of carbide. The system containing a large amount of chromium is excellent in corrosion resistance and oxidation resistance, and further has good wear resistance properties. Thus, it is used as a member, for example, a stator vane and a combustor.

Recently, the improvement of thermal efficiency in various heat engines is strongly required in order to improve fuel efficiencies and reduce the effects on the environment. The heat resistance required for heat engine components has been extremely demanding. For that reason, the development of a novel heat-resistant material as an alternative to the conventional nickel- or cobalt-based alloys has been examined.

With reference to novel heat-resistant alloys, many research reports have so far been published. In recent years, noble-metal materials such as Ir system and Pt system have been attracting a lot of attention (Nonpatent document 1). Both Ir and Pt exhibit good oxidation resistance, and further there is a report that an intermetallic compound such as $Ir_3Nb$ having the $L1_2$-structure which is the same as that of the γ'-phase of nickel-based alloy is used as a strengthening phase. (Patent document 2)

Nonpatent document 1: JOM, 56 (9), 2004, pp. 34-39

Patent document 2: JP-A 2001-303152

DISCLOSURE OF THE INVENTION

The present inventors investigated and examined various precipitates which are effective in strengthening the iridium-based alloy. As a result, they discovered intermetallic compounds $Ir_3(Al,W)$ of the γ'-phase with the $L1_2$ structure and found that the intermetallic compound is an effective factor for strengthening.

An objective of the present invention is to provide an iridium-based alloy in which a high temperature strength, heat-resisting property, and oxidation resistance which exceed that of conventional nickel-based alloys are imparted by dispersing the intermetallic compounds $Ir_3(Al,W)$ of the γ'-phase effective in improving the high temperature strength in a matrix excellent in heat-resisting property, and is suitable for gas turbine members, engine members for aircraft, chemical plant materials, engine members for automobile such as turbocharger rotors, and high temperature furnace members, on the basis of the findings.

The iridium-based alloy of the present invention has a first basic composition which includes, in terms of mass proportion, 0.1 to 1.5% of Al, 1.0 to 45% of W, and Ir as the remainder when strengthening is obtained by dispersedly precipitate $L1_2$-type intermetallic compounds $Ir_3(Al,W)$, and further has a second basic composition which includes greater than 1.5 and 9.0% or less of Al, 1.0 to 45% of W, and Ir as the remainder when strengthening is obtained by dispersedly precipitate $L1_2$-type intermetallic compounds $Ir_3(Al,W)$ and B2-type intermetallic compounds Ir(Al,W).

One or more alloy components selected from Group (I) and/or Group (II) are added to the iridium-based alloy having the first and second basic compositions if necessary. When the alloy components of Group (I) are added, the total content is selected from the range of 0.001 to 2.0%, and when the alloy components of Group (II) are added, the total content is selected from the range of 0.1 to 48.9%, without making the Ir content 50% or less.

Group (I):

0.001 to 1.0% of B, 0.001 to 1.0% of C, 0.001 to 0.5% of Mg, 0.001 to 1.0% of Ca, 0.01 to 1.0% of Y, 0.01 to 1.0% of La or misch metal Group (II):

0.1 to 48.9% of Co, 0.1 to 48.9% of Ni, 0.1 to 20% of Fe, 0.1 to 20% of V, 0.1 to 15% of Nb, 0.1 to 25% of Ta, 0.1 to 10% of Ti, 0.1 to 15% of Zr, 0.1 to 25% of Hf, 0.1 to 15% of Cr, 0.1 to 15% of Mo, 0.1 to 25% of Rh, 0.1 to 25% of Re, 0.1 to 15% of Pd, 0.1 to 25% of Pt, and 0.1 to 15% of Ru In a component system to which an alloy element of Group (II) is added, the $L1_2$-type intermetallic compound is represented by $(Ir,X)_3(Al, W, Z)$ (wherein, X is Co, Fe, Cr, Rh, Re, Pd, Pt and/or Ru, Z is Mo, Ti, Nb, Zr, V, Ta, and/or Hf, and nickel is included in both X and Z.). Further, a numerical subscript shows atom ratio of each element.

When the iridium-based alloy prepared to a predetermined composition is subjected to heat treatment in the range of 800 to 1800° C., $L1_2$ type intermetallic compounds or $L1_2$ type and B2 type intermetallic compounds are precipitated and the high temperature characteristics are improved. As for the heat treatment, the following conditions are employed: 1300° C.×24 hrs., 1300° C.×24 hrs.→1100° C.×12 hrs., and 1300° C.×24 hrs.→900° C.×1 hr.

BEST MODE FOR CARRYING OUT THE INVENTION

Figure 1:
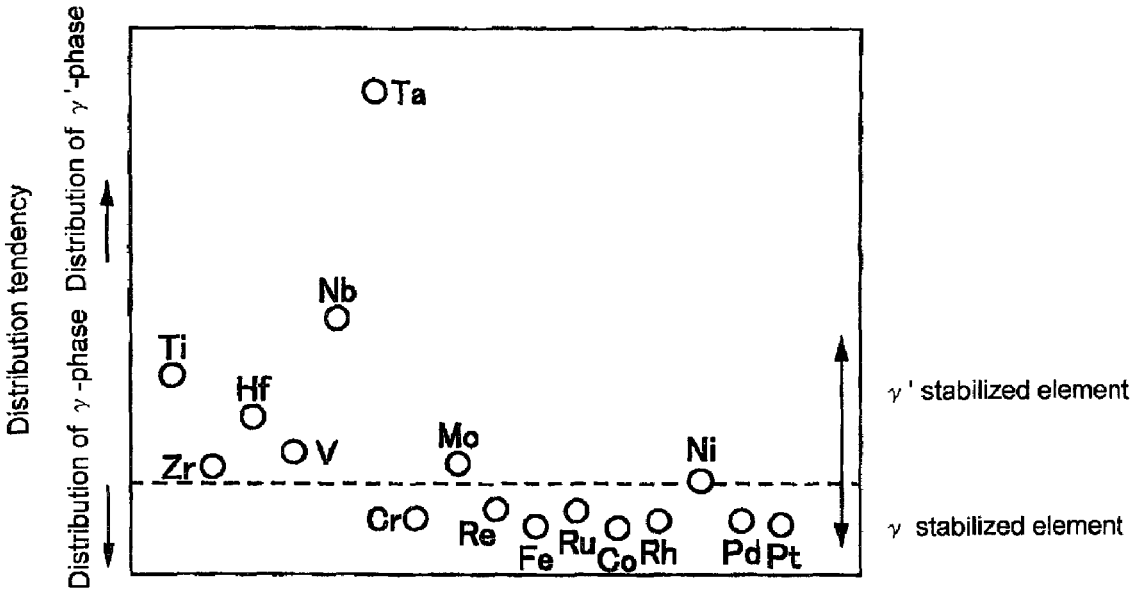
FIG. 1 is a graph showing distribution tendency of each element on the matrix (γ-phase) and γ'-phase.

The present inventors has found that a high temperature strength is significantly improved when intermetallic compounds $Ir_3(Al,W)$ of γ'-phase with the $L1_2$-type is precipitated in an Ir—Al—W ternary system alloy. $Ir_3(Al,W)$ has the same crystal structure as a $Ni_3Al$ (γ') phase, which is a major strengthening phase of the Ni-base alloy and has a good compatibility with the matrix. Further, it contributes to the high strengthening of the alloy since it can be precipitated uniformly and finely. Ir to be used as a matrix has a high melting point as high as 2410° C. and extremely excellent characteristics of oxidation resistance.

For that reason, the iridium-based alloy having $Ir_3(Al,W)$ dispersedly precipitated in a matrix has high temperature characteristics which exceed conventional nickel-based superalloys as follows:

(1) Ir has a melting point which is nearly 1000° C. higher than that of the nickel-based alloy and is extremely excellent in heat resistance;

(2) Ir in itself has oxidation resistance superior to Ni; and (3) The γ'-phase $Ir_3(Al,W)$ which is a precipitation strengthening phase has a solid solution temperature (about 1800° C.) which is about 600 to 700° C. higher than that of the γ'-phase $Ni_3(Al,Ti)$ of the nickel-based alloy. As with the γ'-phase $Ni_3(Al,Ti)$, the iridium-based alloy has a strong inverse temperature dependence and the high-temperature stability of the precipitation-strengthening phase is also good. Thus, it maintains excellent high temperature characteristics when it is exposed to the temperature atmosphere much higher than the upper temperature limit of the nickel-based alloy.

The iridium-based alloy of the present invention has a melting point of 1000° C., which is higher than that of the nickel-based alloy generally used, and the diffusion coefficient of substitutional element is smaller than Ni. As compared with the nickel-based alloy, the precipitated phase is hardly coarsened and creep-deformed by the atomic diffusion. Improvement of the temperature resistance and considerable improvement of material life are expected.

The mismatch between the intermetallic compound [$Ir_3$(Al,W)] to be used as a strengthening phase and the matrix is up to about 0.5% and the intermetallic compound has a structural stability exceeding that of the nickel-based alloy which is precipitated and strengthened with the γ'-phase.

In the iridium-based alloy of the present invention, the component and composition are specified in order to disperse an appropriate amount of $L1_2$-type intermetallic compound [$Ir_3$(Al,W)] or [$(Ir,X)_3$(Al, W, Z)]. A basic composition includes 0.1 to 9.0% of Al and 1.0 to 45% of W. Furthermore, in the case where X component or Z component is included, the alloy is designed so as to contain greater than 50% of Ir. In the case of the system in which the Al content is as low as 0.1 to 1.5%, $Ir_3(Al,W)$ is precipitated. On the other hand, in the case of the system in which the Al content is as high as greater than 1.5% and 9.0% or less, B2 type intermetallic compound Ir(Al,W) is also precipitated in addition to $Ir_3(Al,W)$.

Al is a major constituting element of the γ'-phase, is required for the precipitation and stabilization of the γ'-phase, and contributes to the improvement in oxidation resistance. When the content of Al is less than 0.1%, the γ'-phase is not precipitated. Even if it is precipitated, it does not contribute to the high temperature strength. However, an excessive amount of Al causes facilitating the formation of a brittle and hard phase, and thus the content is set to the range of 0.1 to 9.0% (preferably 0.5 to 5.0%).

W is a major constituting element of the γ' phase and also has an effect of solid solution strengthening of the matrix. When the content of W is less than 1.0%, the γ'-phase is not precipitated. Even if it is precipitated, it does not contribute to the high temperature strength. When an additive amount of W exceeds 45%, the formation of a harmful phase is facilitated. For that reason, W content is set to the range of 1.0 to 45% (preferably 4.5 to 30%).

One or more alloy components selected from Groups (I) and (II) are added to a basic component system of Ir—Al—W, if necessary. In the case where a plurality of alloy components selected from Group (I) are added, the total content is selected from the range of 0.001 to 2.0%, and in the case where a plurality of alloy components selected from Group (II) are added, the total content is selected from the range of 0.1 to 48.9%, without making the Ir content 50% or less.

Group (I) consists of B, C, Mg, Ca, Y, La, and misch metal.

B is an alloy component which is segregated in the crystal grain boundary to enhance the grain boundary and contributes to the improvement in the high temperature strength. When the content of B is 0.001% or more, the additive effect becomes significant. However, the excessive amount is not preferable in view of the workability, and therefore the upper limit is set to 1.0% (preferably 0.5%). As with B, C is effective in enhancing the grain boundary. Further, it is precipitated as carbide, thereby improving the high temperature strength. Such an effect is observed when 0.001% or more of C is added. However, the excessive amount is not preferable in view of the workability and toughness, and therefore the upper limit of C is set to 1.0% (preferably 0.8%). Mg is effective in preventing the embrittlement of the grain boundary. When the content of Mg is 0.001% or more, the additive effect becomes significant. However, an excessive amount thereof causes inducing the formation of a harmful phase, and thus the upper limit is set to 0.5% (preferably 0.4%). Ca is an alloy component effective for deoxidation and desulfurization and contributes to the improvement in ductility and workability. When the content of Ca is 0.001% or more, the additive effect becomes significant. However, an excessive amount thereof causes reducing the workability, and the upper limit is set to 1.0% (preferably 0.5%). Y, La, and misch metal are components effective in improving the oxidation resistance. When the content thereof is 0.01% or more, their additive effects are produced. However, an excessive amount thereof has an adverse effect on the structural stability, and therefore each of the upper limits is set to 1.0% (preferably 0.5%).

Group (II) consists of Co, Ni, Cr, Ti, Fe, V, Nb, Ta, Mo, Zr, Hf, Rh, Re, Pd, Pt, and Ru. Since two-phase structure (γ+γ') of Ir alloy is extremely fine, it was difficult to determine the detailed composition. According to findings related to the nickel-based or cobalt-based alloy by the present inventors (Patent document 3), it is found that distribution coefficient $Kx^{\gamma'+\gamma}$ of alloy components of Group (II) is not dependant on alloy systems and shows the same tendency.

Patent document 3: JP-A No. 2005-267964

The distribution coefficient $Kx^{\gamma'+\gamma}$ is represented by $Kx^{\gamma'/\gamma}=Cx^{\gamma'}/Cx^{\gamma}$ (provided that $Cx^{\gamma'}$: concentration of element X in γ'-phase (atomic %), $Cx^{\gamma}$: concentration of element x in matrix (γ-phase) (atomic %)) and it shows the ratio of concentration of a predetermined element X contained in γ'-phase to a predetermined element X contained in the matrix (γ-phase). If the distribution coefficient is more than 1, it shows a γ' phase stabilized element. If the distribution coefficient is less than 1, it shows the matrix (γ-phase) stabilized element.

With reference to the iridium-based alloy, the distribution tendency of the added elements to the γ-phase or γ'-phase was examined in the same manner as that of the cobalt-based alloy. As shown in FIG. 1, Ti, Zr, Hf, V, Nb, Ta, and Mo are the γ' phase stabilized elements. Among them, the stabilizing effect of the γ'-phase of Ta is the most effective.

Ni and Co have effects for strengthening the matrix and the total ratio of Ni or Co is dissolved in the γ-phase, which results in obtaining a two-phase structure of (γ+γ') in a large composition range. Further, Ni and Co are substituted by Ir of $L1_2$-type intermetallic compound, and thus the amount of Ir which is a noble metal is controlled and low-cost production is contemplated. When the content of Ni is 0.1% or more and the content of Co is 0.1% or more, the additive effects are observed. However, an excessive amount thereof causes the reduction in the melting point and solid solution temperature of the γ'-phase and the impairment of excellent high temperature characteristics of the iridium-based alloy. Thus, the upper limits of Ni and Co are set to 48.9% (preferably 40%) without making the Ir content 50% or less.

Fe is also substituted by Ir and has an effect of improving workability. When the content of Fe is 0.1% or more, the additive effect becomes significant. However, the excessive amount is responsible for the instability of structure in a high-temperature range, and thus the upper limit of Fe is set to 20% (preferably 5.0%).

Cr forms a fine oxide film on the surface of the iridium-based alloy and is an alloy component which improves the oxidation resistance. Additionally, it contributes to the improvement in the high temperature strength and corrosion resistance. When the content of Cr is 1.0% or more, such an effect becomes significant. However, the excessive amount causes the workability deterioration, and thus the upper limit of Cr is set to 15% (preferably 10%).

Mo is an effective alloy component for the stabilization of the γ'-phase and solid solution strengthening of the matrix. When the content of Mo is 0.1% or more, the additive effect is observed. However, the excessive amount causes workability deterioration, and thus the upper limit of Mo is set to 15% (preferably 10%).

Re, Rh, Pd, Pt, and Ru are components effective in improving the oxidation resistance. When the content thereof is 0.1% or more, the additive effects become significant. However, an excessive amount thereof causes inducing the formation of a harmful phase. Thus, the upper limits of Re, Rh, and Pt are set to 25% (preferably 10%), and Pd and Ru are set to 15% (preferably 10%).

Ti, Nb, Zr, V, Ta, and Hf are effective alloy components for the stabilization of the γ'-phase and the improvement in the high temperature strength. When the content of Ti is 0.1% or more, the content of Nb is 0.1% or more, the content of Zr is 0.1% or more, the content of V is 0.1% or more, the content of Ta is 0.1% or more, and the content of Hf is 0.1% or more, the additive effects are observed. However, an excessive amount thereof causes the formation of harmful phases and the melting point depression, and thus the upper limits of Ti, Nb, Zr, V, Ta, and Hf are set to 10%, 15%, 15%, 20%, 25%, and 25%, respectively.

In the case where the iridium-based alloy, which is prepared to a predetermined composition, is used as a casting material, it is produced by any method such as usual casting, unidirectional coagulation, squeeze casting, and single crystal method.

Ir alloys produced by various melting processes are heated in the range of 800 to 1800° C. (preferably, 900 to 1600° C.) to precipitate intermetallic compound $Ir_3(Al,W)$. $Ir_3(Al,W)$ is an intermetallic compound of $L1_2$-structure and the lattice constant mismatch between $Ir_3(Al,W)$ and the matrix is small. In addition, it is dramatically excellent in the high temperature stability as compared to the γ'-phase [$Ni_3(Al,Ti)$] of the nickel-based alloy and contributes to the improvement in the high temperature strength and heat resistance of the iridium-based alloy. Similarly, intermetallic compound $(Ir,X)_3(Al, W, Z)$ produced in the component system to which alloy component of Group (II) is added contribute to the improvement in the high temperature strength and heat resistance of the iridium-based alloy.

It is preferable that the $L1_2$-type intermetallic compound [$Ir_3(Al,W)$] or [$(Ir,X)_3(Al, W, Z)$] is precipitated on the matrix under conditions where the particle diameter is 3 nm to 1 μm and the precipitation amount is about 20 to 85% by volume. Precipitation-strengthening effect is obtained when the particle diameter of the precipitate is 3 nm or more. However, the precipitation-strengthening effect is reduced when the particle diameter exceeds 1 μm. For the purpose of obtaining sufficient precipitation-strengthening effect, it is required that the precipitation amount is 20% by volume or more. However, there is a concern that the ductility is lowered when the precipitation amount exceeds 85% by volume. In order to give a preferable particle diameter and precipitation amount, it is preferable that the aging treatment is performed gradually in a predetermined temperature region.

The iridium-based alloy thus produced is excellent in high temperature characteristics and is used as a suitable material for gas turbine members, engine members for aircraft, chemical plant materials, engine members for automobile such as turbocharger rotors, and high temperature furnace members. Since it has the high strength as well as the high elasticity and is excellent in corrosion resistance and wear resistance, it can be used as a material for build-up materials, spiral springs, springs, wires, belts, cable guides, and the like.

EXAMPLE 1

The cobalt-based alloy with the composition of Table 1 was smelted by arc melting in an inert gas atmosphere, followed by casting into an ingot. Test pieces obtained from the ingot were subjected to the aging treatment shown in Table 2, followed by texture observation, composition analysis, and characteristic test.

Each test result is shown in Table 3. In Table 3, the γ', B2 shows coexistence of the γ'-phase and the B2 [Ir(Al,W)] phase.

In Test Nos. 1 to 3 where relatively small amounts of Al and W were added, only γ'-phase was detected as a precipitate. When it was compared with Alloy No. 6 (Test No. 9) of nearly pure iridium, the Vickers hardness increased by nearly twice and the effects of addition of Al and W were reduced. As shown in the structure photograph of FIG. 2, in the case of Alloy Nos. 3 to 5 (Test Nos. 4 to 8), Ir(Al,W) phase of B2 structure was precipitated in addition to the γ'-phase. The sample with the B2 phase became much harder than the alloy in which only γ'-phase was precipitated. Thus, it is found that the B2 phase contributes to the strengthening of materials.

In the case of Test Nos. 4 to 6, different aging treatments were given to the same Alloy No. 3. As compared with Test No. 4 where a single aging treatment was performed, much finer precipitate was obtained when multiple aging treatments were performed (Test No. 5), or the treatments were performed at low temperature (Test No. 6). Consequently, the precipitation strengthening is contemplated.

Any of the samples in examples of the present invention showed excellent high temperature characteristics and the Vickers hardness of 300 HV or more was maintained at 1000° C. Further, the oxidation resistance was also good, coupled with excellent oxidation resistance of Ir in itself.

Although Test No. 9 had a good oxidation resistance, neither solid solution strengthening nor precipitation strengthening was expected because the additive amounts of Al and W were insufficient. The Vickers hardness was low. In the case of Test No. 10, precipitates were observed in only B2 phase and they were coarsened, and thus the hardness was poor.

TABLE 1

| Ingoted iridium-based alloy | | | | | | | | |
|---|---|---|---|---|---|---|---|---|
| Alloy | (Component system containing low Al) | | Alloy | (Component system containing high Al) | | Alloy | (Comparative example) | |
| No. | Al | W | No. | W | Al | No. | Al | W |
| 1 | 0.7 | 5.0 | 4 | 1.6 | 30.4 | 6 | 0.1 | 0.5 |
| 2 | 1.0 | 15.1 | 5 | 3.4 | 5.8 | 7 | 9.3 | 7.5 |
| 3 | 1.5 | 10.5 | | | | | | |

The content of the alloy components is expressed as % by mass.

TABLE 2

| Heat treatment conditions | |
|---|---|
| Heat treatment No. | Heat treatment conditions |
| 1 | At 1300° C. × soaking for 24 hours<br>→ Water quenching |
| 2 | At 1300° C. × soaking for 24 hours<br>→ Water quenching<br>→ At 1100° C. × soaking for 12 hours<br>→ Water quenching |
| 3 | At 1300° C. × soaking for 24 hours<br>→ Water quenching<br>→ At 900° C. × soaking for 1 hour<br>→ Water quenching |

TABLE 3

| Alloy components, metallic structure according to heat treatment, physical properties | | | | | | |
|---|---|---|---|---|---|---|
| Test | Alloy | Heat treatment | Type of | Vickers hardness (HV) | | Oxidation |
| No. | No. | No. | precipitate | (25° C.) | (1000° C.) | resistance |
| 1 | 1 | 1 | γ' | 435 | 321 | ◎ |
| 2 | 2 | 1 | γ' | 545 | 413 | ◎ |
| 3 | 3 | 2 | γ' | 622 | 501 | ◎ |
| 4 | 4 | 1 | γ', B2 | 654 | 441 | ○ |
| 5 | 5 | 2 | γ', B2 | 711 | 510 | ○ |
| 6 | 6 | 3 | γ', B2 | 749 | 552 | ○ |
| 7 | 7 | 1 | γ', B2 | 480 | 310 | ○ |
| 8 | 8 | 1 | γ', B2 | 506 | 382 | ○ |
| 9 | 9 | 1 | — | 240 | 178 | ◎ |
| 10 | 10 | 1 | B2 | 381 | 205 | ○ |

Figure 2:
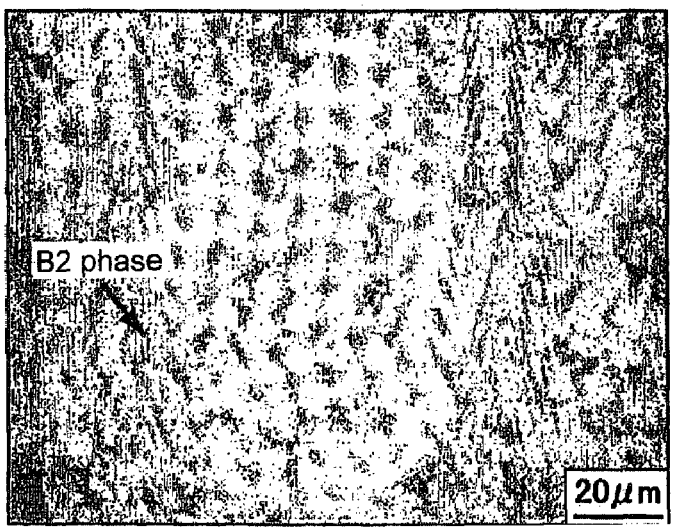
FIG. 2 is an optical microscope image showing aging materials of an Ir-1.5Al-10.5W alloy.
Figure 3:
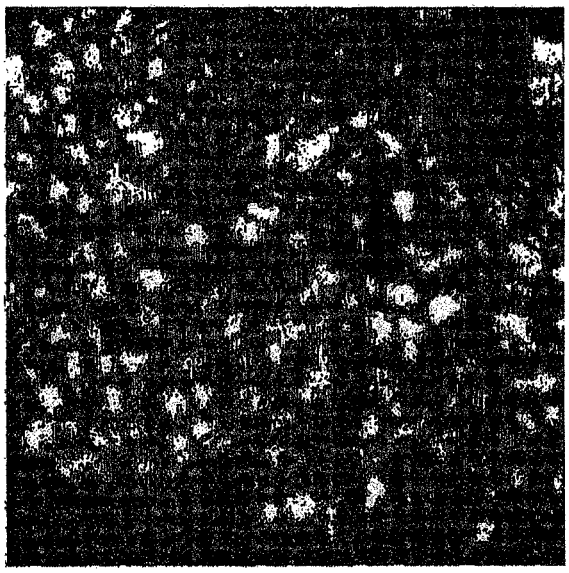
FIG. 3 is a TEM image showing a two-phase structure of the Ir-1.5Al-10.5W alloy.
Figure 4:
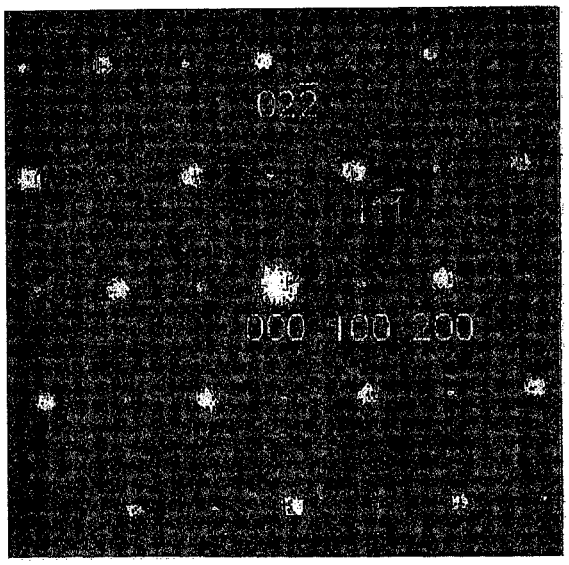
FIG. 4 is an electron diffraction pattern showing the $L1_2$-type structure of the Ir-1.5Al-10.5W alloy.

FIG. 2 shows an optical microscope photograph of Alloy No. 3. which was subjected to aging at 1300° C. It was found that the Ir(Al,W) phase of B2 structure formed at the time of dissolution was precipitated in the grain boundary. As shown in a dark field image of FIG. 3, when the inside of grains of the same material was observed by TEM, fine precipitates were uniformly dispersed and had the same texture as the nickel-based superalloy conventionally used. From the electron-diffraction pattern of FIG. 4, it was confirmed that the crystal structure of the precipitates was the $L1_2$ structure.

Figure 5:
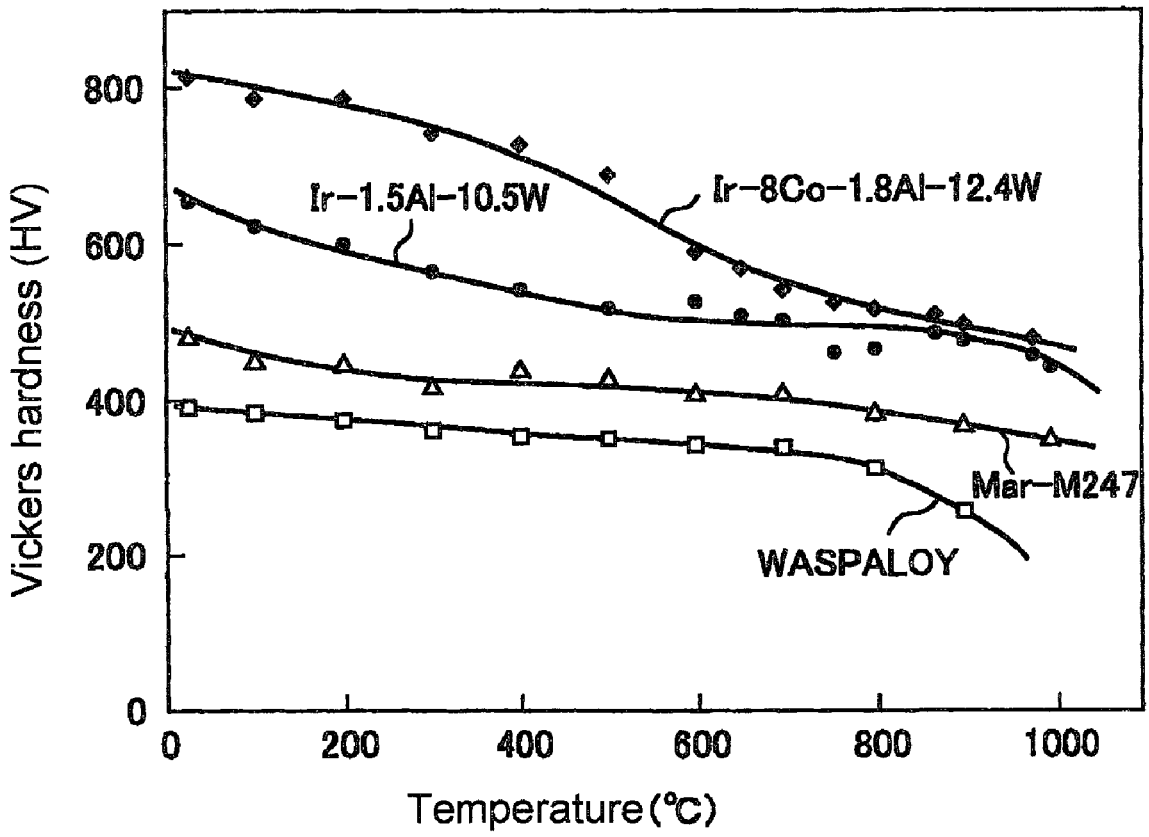
FIG. 5 is a graph showing the temperature dependence of Vickers hardness of Ir—Al—W alloy, Ir—Co—Al—W alloy, and conventional nickel-based alloys (WASPALOY, Mar-M247).

As is apparent form the temperature dependence of Vickers hardness shown in FIG. 5, Alloy No. 3 after the heat treatment exhibited an excellent strength even at high temperature and a Vickers hardness greater than 400 HV was maintained even if it was subjected to a high temperature atmosphere (around 1000° C.).

The hardness of Mar-M247 or Waspaloy which is used as a nickel-based heat-resistant alloy is shown in FIG. 5. It is found that Alloy No. 3 of the present invention has more excellent high temperature strength than Mar-M247 and Waspaloy in the range of room temperature to 1000° C.

Mar-M247 (balance being nickel)

Cr: 8.5% Co: 10% W: 10% Ta: 3% Al: 5.5% Ti: 1% Hf: 1.5% C: 0.15%

Waspaloy (balance being nickel)

Cr: 19.5% Mo: 4.3% Co: 13.5% Al: 1.4% Ti: 3% C: 0.07%

EXAMPLE 2

Table 4 shows alloy designs in which alloy components of Group (I) were added to Ir—Al—W alloy. The amounts of Al and W were determined based on Alloy No. 3 of Table 1. The alloy prepared to a predetermined composition was dissolved and heat-treated in the same manner as described in Example 1, followed by performing the characteristic test. The obtained characteristics are shown in Table 5.

Since small amounts of the elements in Group (I) were added, a major change in the metallic structure was not observed. It is known that B, C, Mg, and Ca tend to be segregated in the grain boundary and all of them contribute to the improvement in high temperature creep strength. As for the hardness, the results showed no large differences compared to that of Alloy No. 3. As with the case of Example 1, the high strength was maintained to high temperatures. It is known that the addition of Y and La is effective in improving the oxidation resistance of the nickel-based alloy. The same effect was also observed in the component system of the present invention. Since the reduction of strength characteristics caused by the addition of both elements is small, it can be understood that it is very effective in improving the oxidation resistance.

TABLE 4

| Iridium-based alloy containing alloy component of Group (I) (%) | | | |
|---|---|---|---|
| Alloy No. | Al | W | Group (I) |
| 8 | 1.5 | 10.5 | B: 0.2 |
| 9 | 1.5 | 10.5 | C: 0.5 |
| 10 | 1.5 | 10.5 | Mg: 0.1 |
| 11 | 1.5 | 10.5 | Ca: 0.1 |
| 12 | 1.5 | 10.5 | Y: 0.2 |
| 13 | 1.5 | 10.5 | La: 0.2 |
| 14 | 1.5 | 10.5 | B: 0.1 C: 0.1 |

TABLE 5

| Alloy component, metallic structure according to heat treatment, physical properties | | | | | | |
|---|---|---|---|---|---|---|
| Test No. | Alloy No. | Heat treatment No. | Type of precipitate | Vickers hardness (HV) (25° C.) | Vickers hardness (HV) (1000° C.) | Oxidation resistance |
| 11 | 8 | 1 | γ', B2 | 598 | 455 | ○ |
| 12 | 9 | 1 | γ', B2 | 644 | 461 | ○ |
| 13 | 10 | 1 | γ', B2 | 620 | 450 | ○ |
| 14 | 11 | 1 | γ', B2 | 633 | 440 | ○ |
| 15 | 11 | 1 | γ', B2 | 605 | 440 | ◎ |
| 16 | 12 | 1 | γ', B2 | 590 | 423 | ◎ |
| 17 | 13 | 1 | γ', B2 | 625 | 427 | ○ |

EXAMPLE 3

Table 6 shows alloy designs in which alloy components of Group (II) were added to Ir—Al—W alloy. The alloy prepared to a predetermined composition was dissolved, heat-treated in the same manner as described in Example 1, followed by performing the characteristic test. The obtained characteristics are shown in Table 7.

Among elements of Group (II), cobalt and nickel are substituted by Ir and contribute to the solid solution strengthening. In Test Nos. 18 and 19, it was confirmed that the hardness was significantly increased by adding these elements as compared to that of Ir—Al—W ternary alloy. Since Test No. 18 also contribute to the precipitation strengthening of B2 phase, particularly, the increase in the strength is significant. When the results of Table 7 are seen, the amount of Al is generally large. In the case where precipitates are formed in the B2 phase, the value of Vickers hardness is high.

According to FIG. 1, Cr and Fe are matrix (γ) stabilized elements and cause the reduction of precipitation amount of the γ'-phase and the decrease of the solid solution temperature. From the results of Test Nos. 20 and 22, it is found that the hardness is improved by the addition at room temperature and high temperatures. Since Cr has a significant effect on the improvement of the oxidation resistance and the corrosion resistance, so it is an essential element from a practical standpoint. Fe is expected as an inexpensive strengthening element. However, excessive addition of both elements causes formation of a harmful phase and workability deterioration, and therefore the additive amount needs to be adjusted.

Any of Mo, Ti, Zr, Hf, V, Nb, and Ta are elements which stabilize the γ'-phase and exhibit excellent characteristics at room temperature and high temperature. However, these elements have a high tendency to form a brittle intermetallic compound phase, and thus adjustment of the additive amount is required for practical alloy design.

Rh, Re, Pd, Pt, and Ru, which were added in Alloy Nos. 26 to 30, are the same noble-metal elements as iridiums. They have an excellent structural stability and oxidation resistance, and thus the hardness was hardly decreased even at high temperature.

TABLE 6

| Iridium-based alloy containing alloy component of Group (II) | | | |
|---|---|---|---|
| Alloy No. | Alloy components and content (%) Al | W | Group (II) |
| 15 | 1.8 | 12.4 | Co: 8.0 |
| 16 | 1.4 | 12.1 | Ni: 7.8 |
| 17 | 1.7 | 11.4 | Cr: 3.3 |
| 18 | 1.7 | 11.5 | Ti: 3.0 |
| 19 | 0.6 | 10.7 | Fe: 3.3 |
| 20 | 0.8 | 13.1 | V: 3.0 |
| 21 | 1.6 | 11.1 | Nb: 5.6 |
| 22 | 1.6 | 10.6 | Ta: 10.4 |
| 23 | 1.2 | 8.5 | Mo: 2.8 |
| 24 | 1.5 | 10.8 | Zr: 2.7 |
| 25 | 1.2 | 10.4 | Hf: 5.0 |
| 26 | 1.2 | 10.5 | Rh: 1.8 |
| 27 | 1.5 | 10.5 | Re: 5.3 |
| 28 | 1.5 | 10.5 | Pd: 3.1 |
| 29 | 1.5 | 10.5 | Pt: 5.6 |
| 30 | 1.6 | 10.8 | Ru: 3.0 |

TABLE 7

| Alloy component, metallic structure according to heat treatment, physical properties | | | | | | |
|---|---|---|---|---|---|---|
| Test No. | Alloy No. | Heat treatment No. | Type of precipitate | Vickers hardness (HV) (25° C.) | Vickers hardness (HV) (1000° C.) | Oxidation resistance |
| 18 | 15 | 1 | γ', B2 | 856 | 551 | ◎ |
| 19 | 16 | 1 | γ' | 650 | 421 | ○ |
| 20 | 17 | 1 | γ', B2 | 795 | 561 | ◎ |
| 21 | 18 | 1 | γ', B2 | 748 | 488 | ○ |
| 22 | 19 | 1 | γ' | 597 | 395 | ○ |
| 23 | 20 | 1 | γ' | 630 | 440 | ○ |
| 24 | 21 | 1 | γ', B2 | 780 | 585 | ◎ |
| 25 | 22 | 1 | γ', B2 | 906 | 620 | ◎ |
| 26 | 23 | 1 | γ' | 574 | 392 | ○ |
| 27 | 24 | 1 | γ', B2 | 723 | 558 | ○ |
| 28 | 25 | 1 | γ' | 633 | 501 | ○ |
| 29 | 26 | 1 | γ' | 602 | 430 | ◎ |
| 30 | 27 | 1 | γ', B2 | 868 | 590 | ◎ |
| 31 | 28 | 1 | γ', B2 | 805 | 510 | ◎ |
| 32 | 29 | 1 | γ', B2 | 831 | 544 | ◎ |
| 33 | 30 | 1 | γ', B2 | 895 | 617 | ◎ |

The invention claimed is:

1. An iridium-based alloy with high heat resistance and high strength comprising: in terms of mass proportion, 0.1 to 9.0% of Al, 1.0 to 45% of W, and Ir as the remainder with inevitable impurities; and a metallic structure having a precipitated $L1_2$-type intermetallic compound of $Ir_3(Al,W)$ in terms of atom ratio, in a component system containing 0.1 to 1.5% of Al and having a precipitated $L1_2$-type intermetallic compound of $Ir_3(Al,W)$ in terms of atom ratio and a B2 type intermetallic compound of Ir(Al,W) in terms of atom ratio, in a component system containing greater than 1.5% to 9.0% or less of Al.

2. The iridium-based alloy according to claim 1, further comprising: a total of 0.001 to 2.0% by mass of one or more components selected from Group (I), and greater than 50% of Ir as the remainder, wherein Group (I) consists of 0.001 to 1.0% of B, 0.001 to 1.0% of C, 0.001 to 0.5% of Mg, 0.001 to 1.0% of Ca, 0.01 to 1.0% of Y, 0.01 to 1.0% of La and misch metal.

3. The iridium-based alloy according to claim 1, further comprising:

a total of 0.1 to 48.9% by mass of one or more components selected from Group (II), and greater than 50% of Ir as the remainder with inevitable impurities; and a metallic structure having a precipitated $L1_2$-type intermetallic compound of $(Ir,X)_3(Al,W,Z)$ in terms of atom ratio in a component system containing 0.1 to 1.5% of Al, and having a precipitated $L1_2$-type intermetallic compound of $(Ir,X)_3(Al,W,Z)$ in terms of atom ratio and a B2 type intermetallic compound (Ir,X)(Al,W,Z) in terms of atom ratio, in a component system containing greater than 1.5% and 9.0% or less of Al wherein, X is one or more elements selected from the group consisting of Co, Fe, Cr, Rh, Re, Pd, Pt, Ru, and Ni, Z is one or more elements selected from the group consisting of Mo, Ti, Nb, Zr, V, Ta, Hf, and Ni, and Group (II) consists of 0.1 to 48.9% of Co, 0.1 to 48.9% of Ni, 0.1 to 20% of Fe, 0.1 to 20% of V, 0.1 to 15% of Nb, 0.1 to 25% of Ta, 0.1 to 10% of Ti, 0.1 to 15% of Zr, 0.1 to 25% of Hf, 0.1 to 15% of Cr, 0.1 to 15% of mo, 0.1 to 25% of Rh, 0.1 to 25% of Re, 0.1 to 15% of Pd, 0.1 to 25% of Pt, and 0.1 and 15% of Ru.

4. The iridium-based alloy according to claim 2, further comprising:

a total of 0.1 to 48.9% by mass of one or more components selected from Group (II), and greater than 50% of Ir as the remainder with inevitable impurities; and a metallic structure having a precipitated $L1_2$-type intermetallic compound of $(Ir,X)_3(Al,W,Z)$ in terms of atom ratio in a component system containing 0.1 to 1.5% of Al, and having a precipitated $L1_2$-type intermetallic compound of $(Ir,X)_3(Al,W,Z)$ in terms of atom ratio and a B2 type intermetallic compound (Ir,W)(Al, W, Z) in terms of atom ratio, in a component system containing greater than 1.5% and 9.0% or less of Al wherein, X is one or more elements selected from the group consisting of Co, Fe, Cr, Rh, Re, Pd, Pt, Ru, and Ni, Z is one or more elements selected from the group consisting of Mo, Ti, Nb, Zr, V, Ta, Hf, and Ni, and Group (II) consists of 0.1 to 48.9% of Co, 0.1 to 48.9% of Ni, 0.1 to 20% of Fe, 0.1 to 20% of V, 0.1 to 15% of Nb, 0.1 to 25% of Ta, 0.1 to 10% of Ti, 0.1 to 15% of Zr, 0.1 to 25% of Hf, 0.1 to 15% of Cr, 0.1 to 15% of mo, 0.1 to 25% of Rh, 0.1 to 25% of Re, 0.1 to 15% of Pd, 0.1 to 25% of Pt, and 0.1 and 15% of Ru.

5. A process for producing the iridium-based alloy with high heat resistance and high strength, comprising the steps of:

heat-treating the iridium-based alloy with the composition according to claim 1 in the range of 800 to 1800° C. one or more times;

allowing an $L1_2$-type intermetallic compound to precipitate in the component system containing 0.1 to 1.5% of Al; and allowing the $L1_2$-type intermetallic compound and the B2 type intermetallic compound to precipitate in the component system containing greater than 1.5% and 9.0% or less of Al.

6. A process for producing the iridium-based alloy with high heat resistance and high strength, comprising the steps of:

heat-treating the iridium-based alloy with the composition according to claim 2 in the range of 800 to 1800° C. one or more times; and allowing both an $L1_2$-type intermetallic compound to precipitate in the component system containing 0.1 to 1.5% of Al; and allowing the $L1_2$-type intermetallic compound and the B2 type intermetallic compound to precipitate in the component system containing greater than 1.5% and 9.0% or less of Al.

7. A process for producing the iridium-based alloy with high heat resistance and high strength, comprising the steps of: p1 heat-treating the iridium-based alloy with the composition according to claim 3 in the range of 800 to 1800° C. one or more times;

allowing an $L1_2$-type intermetallic compound to precipitate in the component system containing 0.1 to 1.5% of Al; and allowing the $L1_2$-type intermetallic compound and the B2 type intermetallic compound to precipitate in the component system containing greater than 1.5% and 9.0% or less of Al.

* * * * *